US009956496B2

(12) United States Patent
Yang

(10) Patent No.: US 9,956,496 B2
(45) Date of Patent: May 1, 2018

(54) INFLATABLE FLYING DISC

(71) Applicant: FengFei Yang, Kowloon (CN)

(72) Inventor: FengFei Yang, Kowloon (CN)

( * ) Notice: Subject to any disclaimer, the term of this patent is extended or adjusted under 35 U.S.C. 154(b) by 0 days. days.

(21) Appl. No.: 14/979,375

(22) Filed: Dec. 27, 2015

(65) Prior Publication Data

US 2017/0173488 A1 Jun. 22, 2017

(30) Foreign Application Priority Data

Nov. 6, 2015 (CN) ..... 2015 1 0750176

(51) Int. Cl.

| | |
|---|---|
| ***A63H 27/00*** | (2006.01) |
| ***A63H 33/18*** | (2006.01) |
| ***A63H 23/10*** | (2006.01) |
| ***A63H 33/22*** | (2006.01) |
| ***A63H 33/26*** | (2006.01) |

(52) U.S. Cl.

CPC ..... *A63H 33/18* (2013.01); *A63H 23/10* (2013.01); *A63H 33/22* (2013.01); *A63H 33/26* (2013.01)

(58) Field of Classification Search

CPC ..... A63H 33/18; A63H 23/10; A63H 33/22; A63H 33/26

USPC ..... 446/46, 61, 47

See application file for complete search history.

(56) References Cited

U.S. PATENT DOCUMENTS

| | | | | |
|---|---|---|---|---|
| 4,135,325 | A * | 1/1979 | Lehman | A63H 33/18 441/41 |
| 4,318,244 | A * | 3/1982 | Magid | A63H 33/18 446/188 |
| 4,335,536 | A * | 6/1982 | Magid | A63H 33/18 446/224 |
| 6,783,421 | B1 * | 8/2004 | Lopez | A63H 23/10 446/153 |
| 2005/0277356 | A1 * | 12/2005 | Chernick | A63H 33/18 446/46 |

* cited by examiner

*Primary Examiner* — Vishu Mendiratta
(74) *Attorney, Agent, or Firm* — Donald J. Ersler

(57) ABSTRACT

An inflatable flying disc isincludes an inflatable annular body having an air inlet to inflate and deflate the flying disc; a base membrane being attached to the inflatable annular body along a peripheral edge; a first membrane being attached to the base membrane along the perimeter of the first membrane. The base membrane and the first membrane is form a water-tight compartment.

4 Claims, 22 Drawing Sheets

INFLATABLE FLYING DISC

FIELD OF THE INVENTION

The present relates to a sport or a recreational article, in particular, a kind of inflatable flying disc.

BACKGROUND

Recreational devices have a wide appeal to the population in general. These recreational devices isis used at home, on vacation or just about anywhere that will allow the recreational devices to be operated. In particular, flying recreational devices participate in this wide appeal to the population. The flying recreational devices is employ lights to provide visual identification and a decorative addition to these devices. However, there is a need for electrical circuits to operate these recreational devices. The electrical circuits need to be operated in a waterproof environment in case the flying recreational device contacts water.

SUMMARY

An inflatable flying disc includes an inflatable annular body having an air inlet to inflate and deflate the flying disc; a base membrane being attached to the inflatable annular body along a peripheral edge; a first membrane being attached to the base membrane along the perimeter of the first membrane. The base membrane and the first membrane is form a watertight compartment.

The base membrane is a circular base membrane.

The first membrane is a first top membrane positioned on the top of the base membrane.

The inflatable flying disc includes a second membrane being attached to the first membrane.

The second membrane is a top second membrane positioned on the top of the base membrane.

The watertight chamber is formed by a chamber base and a chamber cap.

A first membrane compartment is formed between first membrane and base membrane.

Base membrane includes an opening to allow access to first membrane compartment.

The inflatable flying disc includes a second membrane compartment formed between first membrane and second membrane, and an opening on first membrane.

The inflatable flying disc includes a hood on top of first membrane.

The inflatable flying disc includes a hood on top of second membrane.

An electronic device is positioned within the first membrane compartment.

An electronic device is positioned within the second membrane compartment.

An electronic device is also be positioned within the first chamber compartment of the watertight chamber.

BRIEF DESCRIPTION OF THE DRAWINGS

The invention is understood by reference to the following description taken in conjunction with the accompanying drawings, in which, like reference numerals identify like elements, and in which.

DETAILED DESCRIPTION

An inflatable flying disc is light-weight, flexible, and able to float on water.

The inflatable flying disc of the present invention is used on the beach, or in any water event, by players of all ages.

The inflatable flying disc of the present invention is contain an electronic light emitting device, and it is traced visually when played in the dark.

The inflatable flying disc of the present invention is contain an electronic sound producing device, and it is heard and followed when played by people who isnot see.

The inflatable flying disc of the present invention is contain an electronic remote control device, and its light and sound effects, or even the flying trajectory isis manipulated remotely.

The body of an inflatable flying disc is substantially air-tight and includes an air inlet for air filling. The air inlet is small, so that it is sealed easily.

However, such conditions make it difficult for electronic devices to be installed into, or withdrew out of the inflatable flying disc.

This invention provides a solution for installing or replacing electronic devices of an inflatable flying disc, without disturbing or damaging its air-tight body.

The inflatable flying disc of the present invention includes an annular inflatable body, a base membrane, top membranes, and water-tight chambers. There is a hood on a top membrane. Furthermore, the flying disc includes openings on base membrane and top membrane. Such openings will allow connection of the compartments within water-tight chamber to the compartments enclosed by top membranes, and also to the compartment within the hood, hence expanding the capacity, and providing a variety of compartment configurations for installing electronic devices into the inflatable flying disc. The electronic device isis placed into the compartment within water-tight chambers, or into the compartments enclosed by the top membranes, or further into the compartment within the hood. Batteries in the electronic devices are hence replaceable and the duration of use of the inflatable flying disc is extended.

Figure 1:
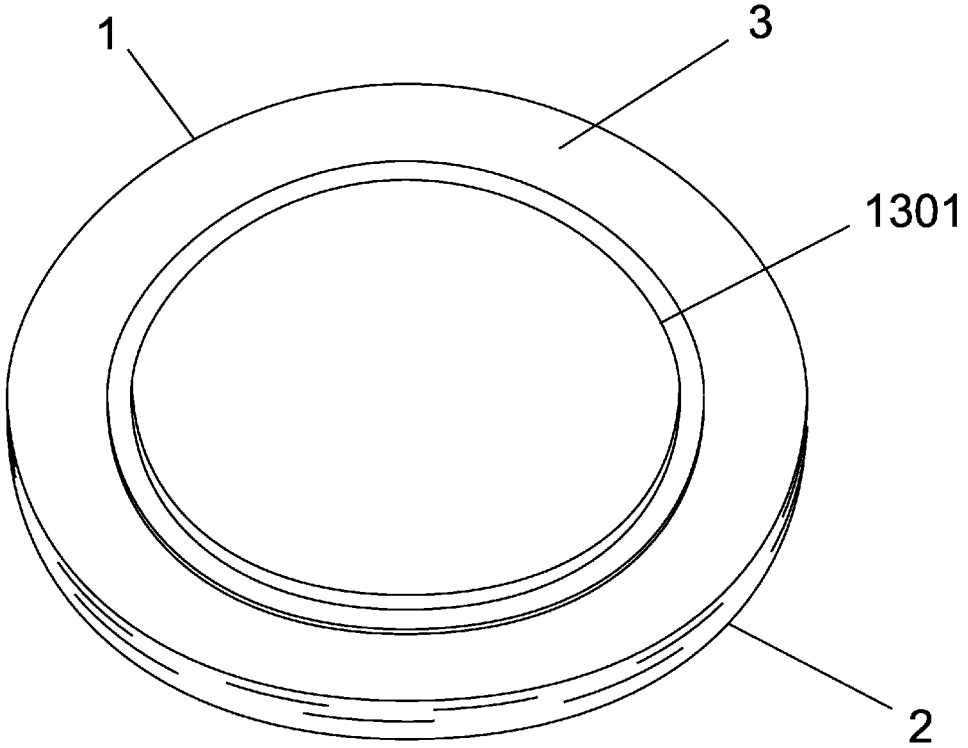
FIG. 1 illustrates a perspective view of the invention.
Figure 2:
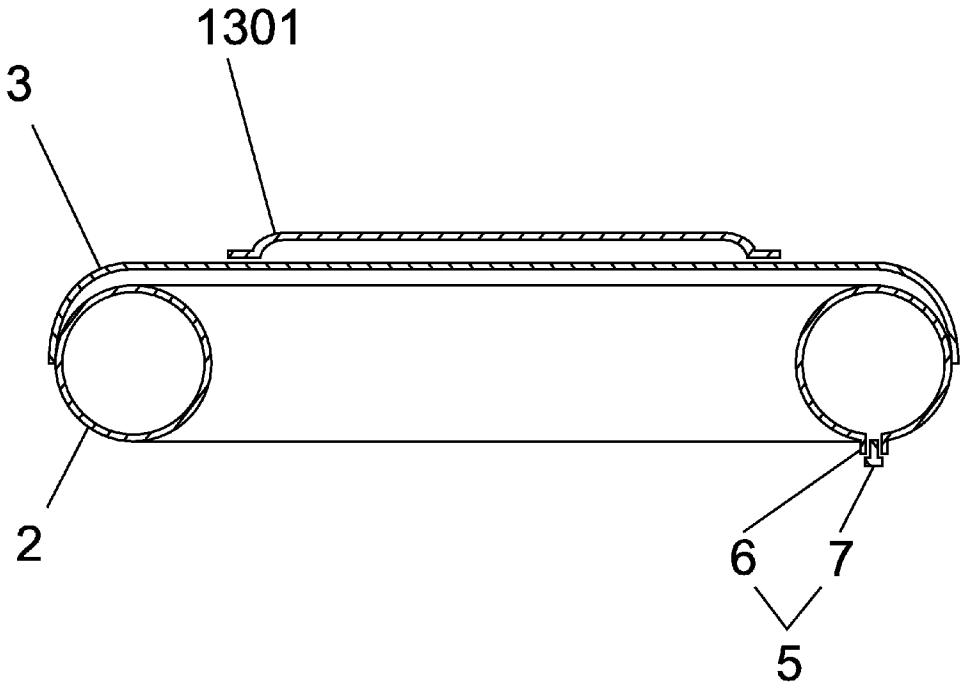
FIG. 2 illustrates a cross-sectional view of the invention.

With reference to FIGS. 1 and 2, the inflatable flying disc 1 includes an inflatable annular body 2, and an air inlet 5, on the external surface of inflatable annular body 2. Air is to be filled into or released out of inflatable annular body 2 by way of air inlet 5. Air inlet 5 isincludes an inlet base 6, and an inlet sealing cap 7. A circular base membrane 3 is attached onto inflatable annular body 2 along their common circumference. Base membrane 3 is permanently attached onto inflatable annular body 2, and is have the substantially the same diameter as inflatable annular body 2. A first top membrane 1301 is attached, along its perimeter, onto base membrane 3. The size of first top membrane 1301 is varied as small as the outer perimeter of water-tight chamber 8, or as big as the circumference of inflatable annular body 2, or one in between. First top membrane 1301 isis permanently attached onto base membrane 3. The present invention isincludes additional top membranes, ie, other than first top membrane 1301, such as a second top membrane 1302 (not shown), so on and so forth. The size range of second top membrane 1302 is similar to that of first top membrane 1301. Second top membrane 1302 is attached, along its perimeter, onto base membrane 3, or on top of first top membrane 1301. Likewise, any subsequent top membrane after second top membrane 1302, will have a similar size range as second top membrane 1302, and isis attached onto base membrane 3, or on top of a membrane other than base membrane 3.

Figure 3:
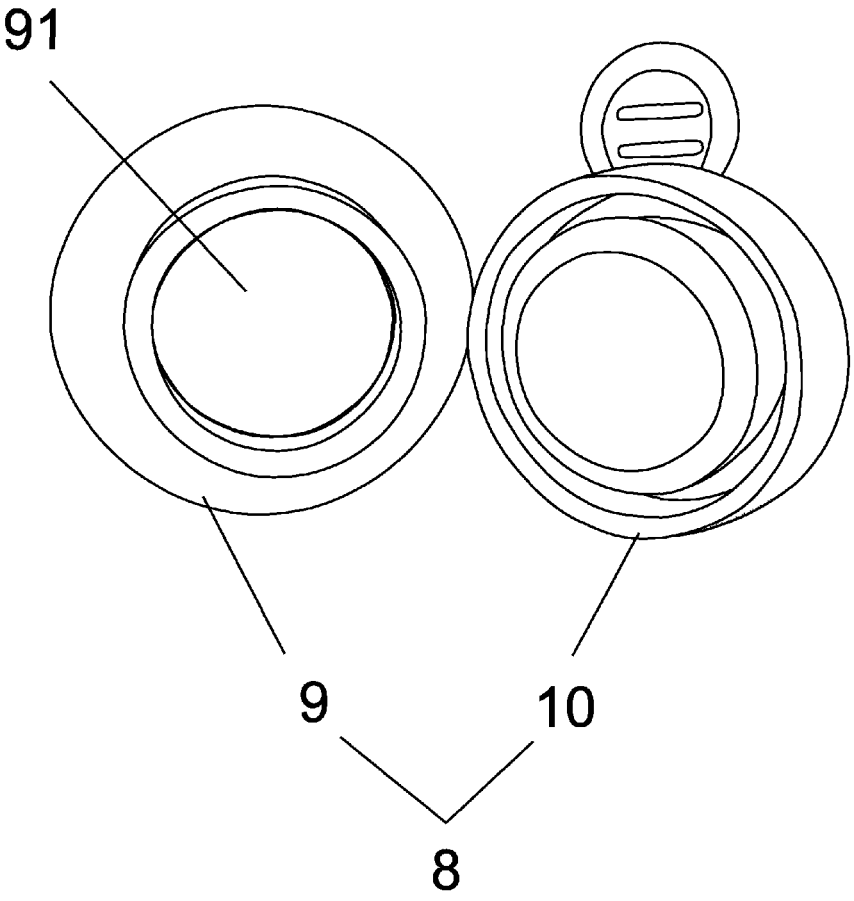
FIG. 3 illustrates a perspective view of the water-tight chamber.

With reference to FIG. 3, there is one, or more than one, water-tight chamber 8 positioned on one side of base membrane 3. A water-tight chamber 8 isincludes a chamber base 9, an opening 91 at one end of chamber base 9, and a water-tight chamber cap 10 for sealing opening 91. With chamber base 9 attached to one side of base membrane 3, opening 91 isis an entrance to a first chamber compartment 11. Upon the sealing up of opening 91 by chamber cap 10, first chamber compartment 11 operates as a water-tight compartment.

Figure 4:
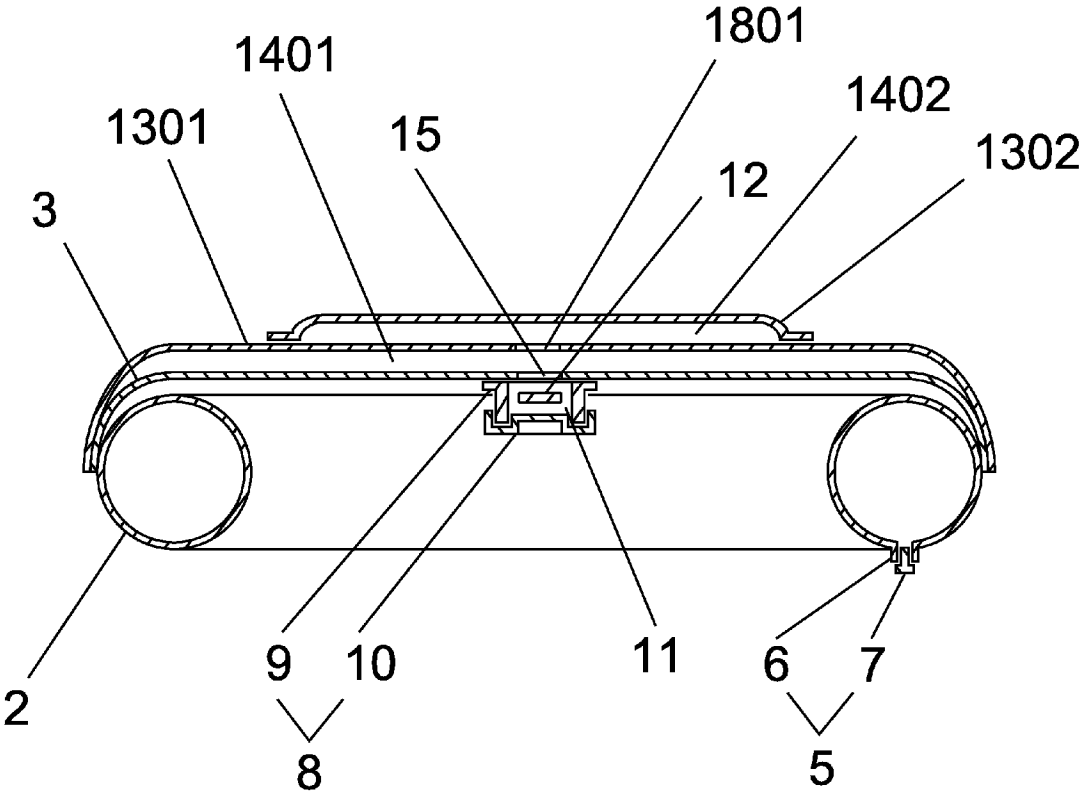
FIG. 4 illustrates a cross-sectional view of the first embodiment of the invention.
Figure 4A:
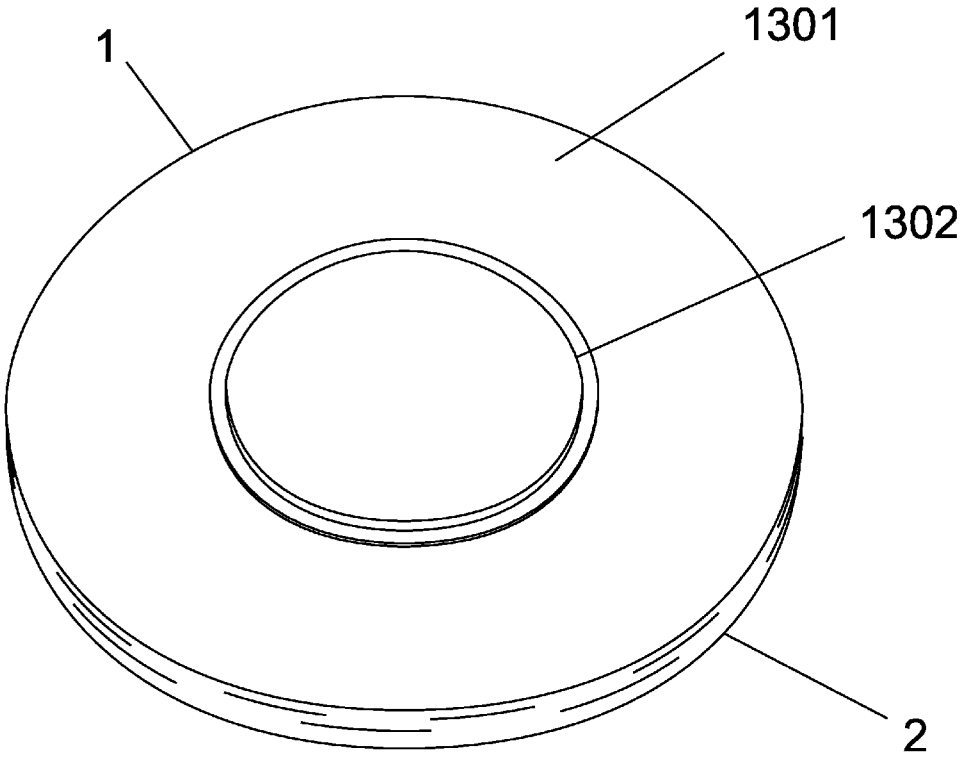
FIG. 4A illustrates a perspective view from top of the first embodiment of the invention.
Figure 4B:
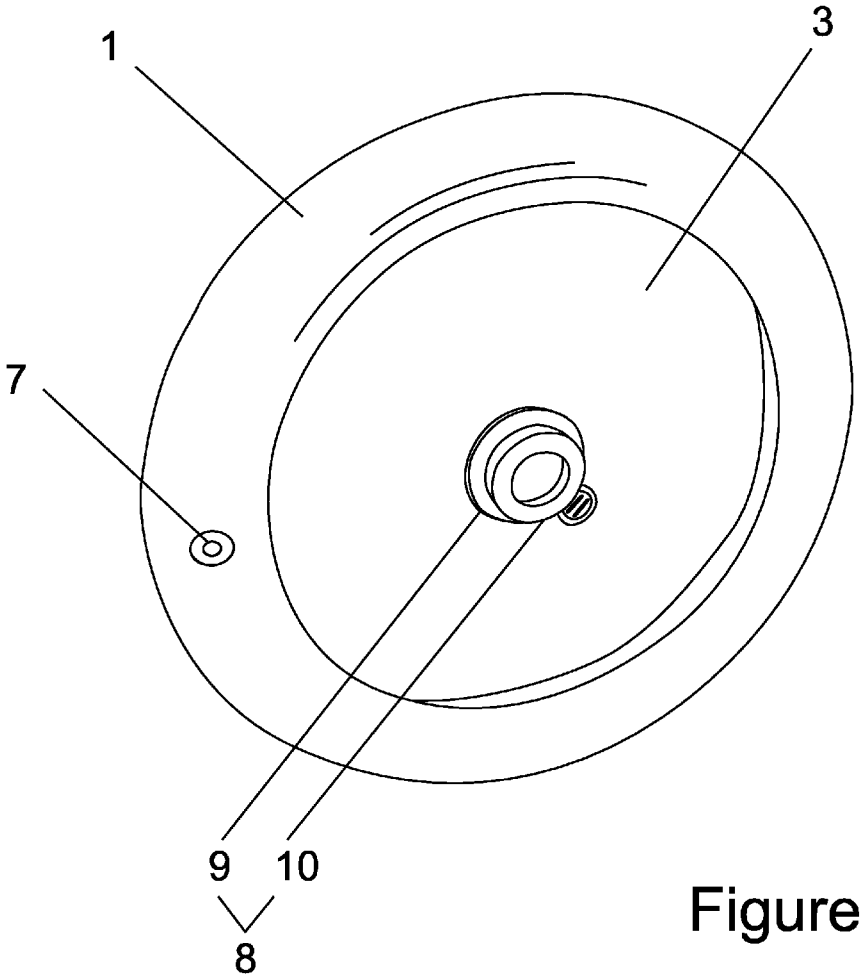
FIG. 4B illustrates a perspective view from bottom of the first embodiment of the invention.

FIG. 4 is a cross-sectional view of the first embodiment of the invention. FIG. 4A illustrates a perspective view from top of the first embodiment of the invention. FIG. 4B illustrates a perspective view from bottom of the first embodiment of the invention.

First top membrane 1301 and base membrane 3 are of the same diameter. First top membrane 1301 and is attached onto base membrane 3 along their common circumference, forming a first membrane compartment 1401. Only one water-tight chamber 8 is shown, but additional is added if necessary. Water-tight chamber 8 is attached to the underside of base membrane 3 of inflatable flying disc 1. A base membrane opening 15 is formed at a position corresponding to first chamber compartment 11, connecting the first membrane compartment 1401 to the first chamber compartment 11. A second top membrane 1302 isis attached, along its perimeter, on top of first top membrane 1301, forming a second membrane compartment 1402. The size of second top membrane 1302 is between the outer perimeter of water-tight chamber 8, and the circumference of inflatable annular body 2. A first membrane opening 1801 isis formed at a position corresponds to first chamber compartment 11, connecting second membrane compartment 1402 to first membrane compartment 1401. Electronic device 12 is placed, through opening 91, into the first chamber compartment 11, or then, through the base membrane opening 15, into first membrane compartment 1401, or further, through the first membrane opening 1801, into the second membrane compartment 1402.

Figure 8:
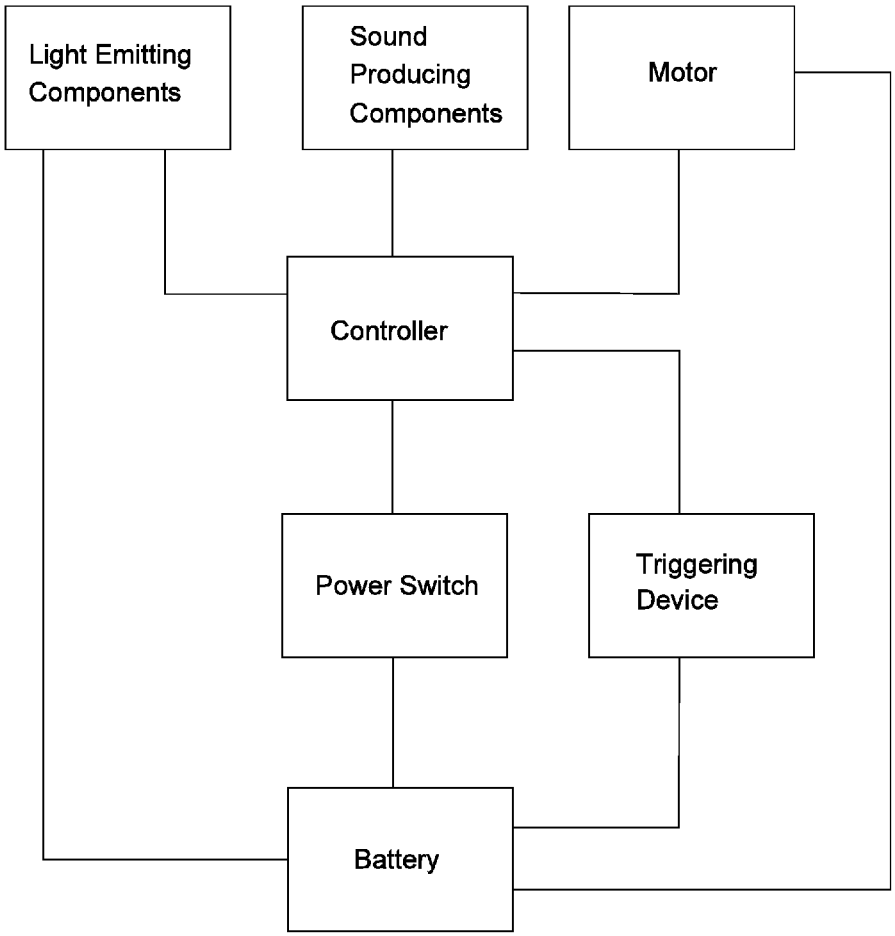
FIG. 8 illustrates a block diagram of the electronic device.

FIG. 8 is a block diagram of the electronic device 12. Electronic device 12 isincludes light emitting components, sound producing components, a motor, a triggering device, and a battery.

Figure 9:
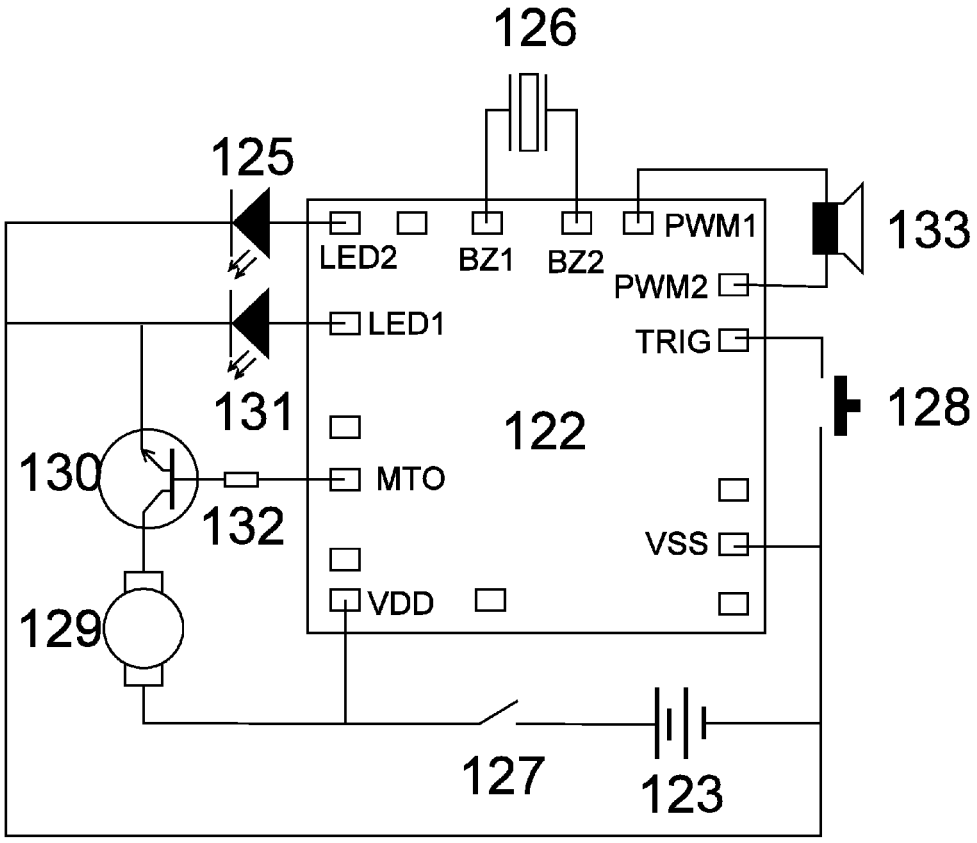
FIG. 9 illustrates a schematic diagram of the electronic device.

With reference to FIG. 9, Electronic device 12 isincludes a controller 122. Controller 122 is a pre-programmed micro-chip. One end of first light emitting component 125 is connected to the light emitting diode LED2 pad of controller 122, while the other end of it is connected to the cathode of battery 123. One end of triggering device 128 is connected to the TRIG pad of controller 122, while the other end of it is connected to the cathode of battery 123. The VSS pad of controller 122 is connected to the cathode of battery 123. One end of second light emitting component 131 is connected to the LED1 pad of controller 122, while the other end of it is connected to the cathode of battery 123 and the emitter of transistor 130. A resistor 132 is in series between the base of transistor 130 and the MTO pad of controller 122. The negative end of motor 129 is connected to the collector of transistor 130, while its positive end is connected to the VDD pad of controller 122. One pole of power switch 127 is connected to the VDD pad of controller 122, while the other end of it is connected to the anode of battery 123. The two ends of first sound producing component 126 are connected to the BZ1 and BZ2 pads of controller 122 respectively. The two ends of second sound producing component 133 are connected to the PWM1 and PWM2 pads of controller 122 respectively.

First light emitting component 125, and second light emitting component 131, is a light emitting diode, a light bulb, or an EL panel. First sound producing component 126 isis a magnetic speaker. Second sound producing component 133 isis a piezo buzzer, or a transducer. Controller 122 isis a Tritan TRS085A1 OTP, or a micro-chip with compatible capability. Power switch 127 is used to establish or cut off the electrical connection between controller 122 and battery 123. Triggering switch 128 is a vibration sensor, or a remote control signal receiver.

When triggering switch 128 is subject to vibration, or a remote control signal is received, a connection between the TRIG pad of controller 122 and the cathode of battery 123 is established. Controller 122 is then subject to a low pull signal, and will begin commanding the light emitting components, the sound producing components, and the motor to work.

Circuit board 121 is a printed circuit board, with the electrical circuitry etched on it.

Figure 5:
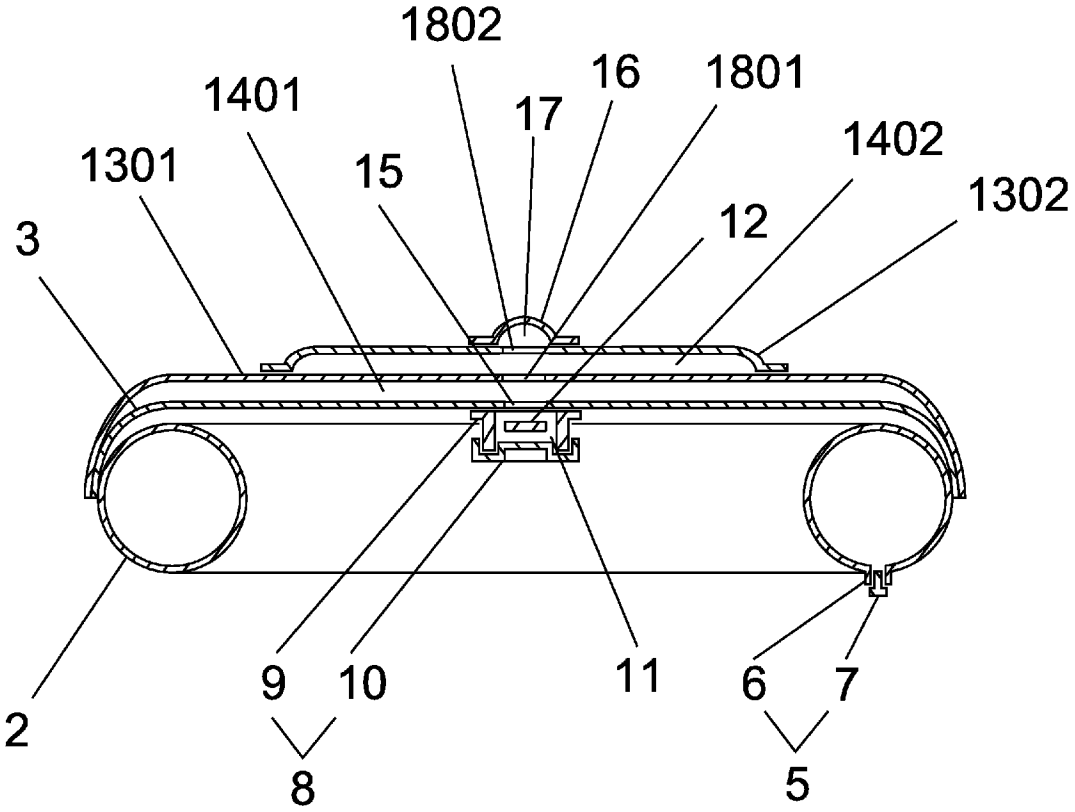
FIG. 5 illustrates a cross-sectional view of the second embodiment of the invention.
Figure 5A:
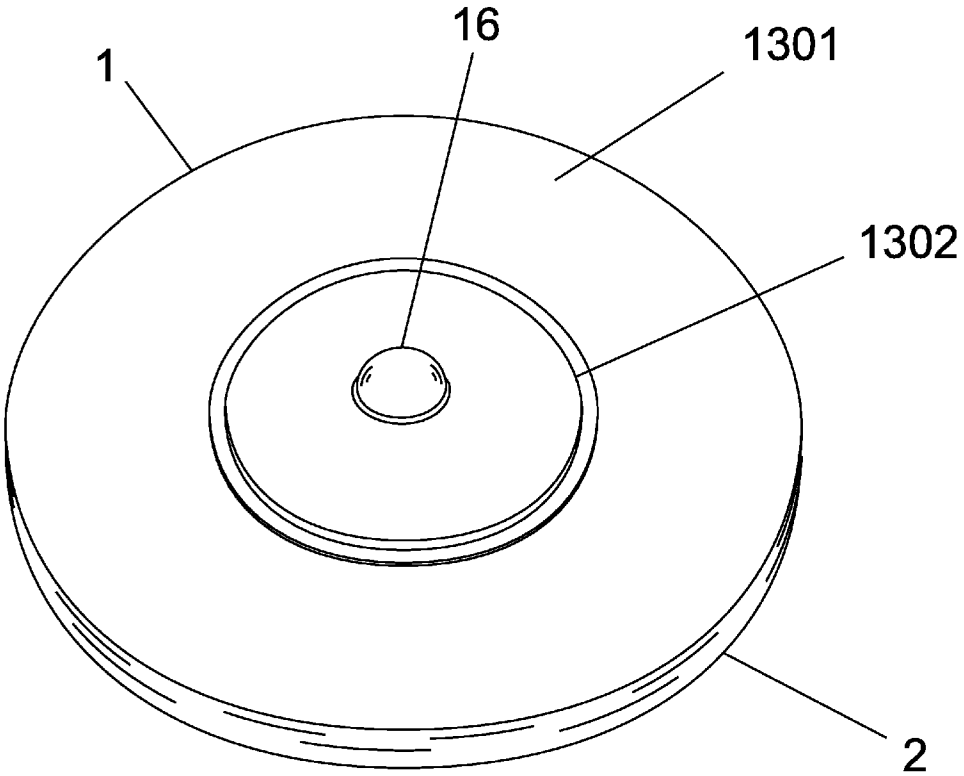
FIG. 5A illustrates a perspective view from top of the second embodiment of the invention.

FIG. 5 is a cross-sectional view of the second embodiment of the invention. FIG. 5A illustrates a perspective view from top of the second embodiment of the invention.

First top membrane 1301 and base membrane 3 isis the same diameter. First top membrane 1301 is attached onto base membrane 3 along their common circumference, forming a first membrane compartment 1401. Only one water-tight chamber 8 is shown, but there isis more than one if necessary. Water-tight chamber 8 isis attached to the underside of base membrane 3 of inflatable flying disc 1. A base membrane opening 15 is formed at a position corresponding to first chamber compartment 11, connecting first membrane compartment 1401 to first chamber compartment 11. A second top membrane 1302 isis attached, along its perimeter, on top of first top membrane 1301, forming a second membrane compartment 1402. The size of second top membrane 1302 is between the outer perimeter of water-tight chamber 8, and the circumference of first membrane 1301. A first membrane opening 1801 is formed at a position corresponds to base membrane opening 15, connecting second membrane compartment 1402 to first membrane compartment 1401. A hood 16 is attached onto the upper side of second top membrane 1302, at a position corresponding to the water-tight chamber 8, forming a hood compartment 17. A second membrane opening 1802 is formed, connecting second membrane compartment 1402 and hood compartment 17. The functions of hood 16 are: a) providing a hood compartment 17, hence expanding the capacity of the first chamber compartment 11, first membrane compartment 1401, and second membrane compartment 1402, providing for a housing electronic devices; b) providing a light effect from the light emitting components 125 and 131 is seen on the upper side of the inflatable flying disc 1; c) balancing the weight of water-tight chamber 8, allowing a smoother and steadier flight of the inflatable flying disc 1. Electronic device 12 isis placed, through opening 91, into first chamber compartment 11, or then, through base membrane opening 15, into first membrane compartment 1401, or then, through first membrane opening 1801, into second membrane compartment 1402, or further, through second membrane opening 1802, into hood compartment 17.

Figure 6:
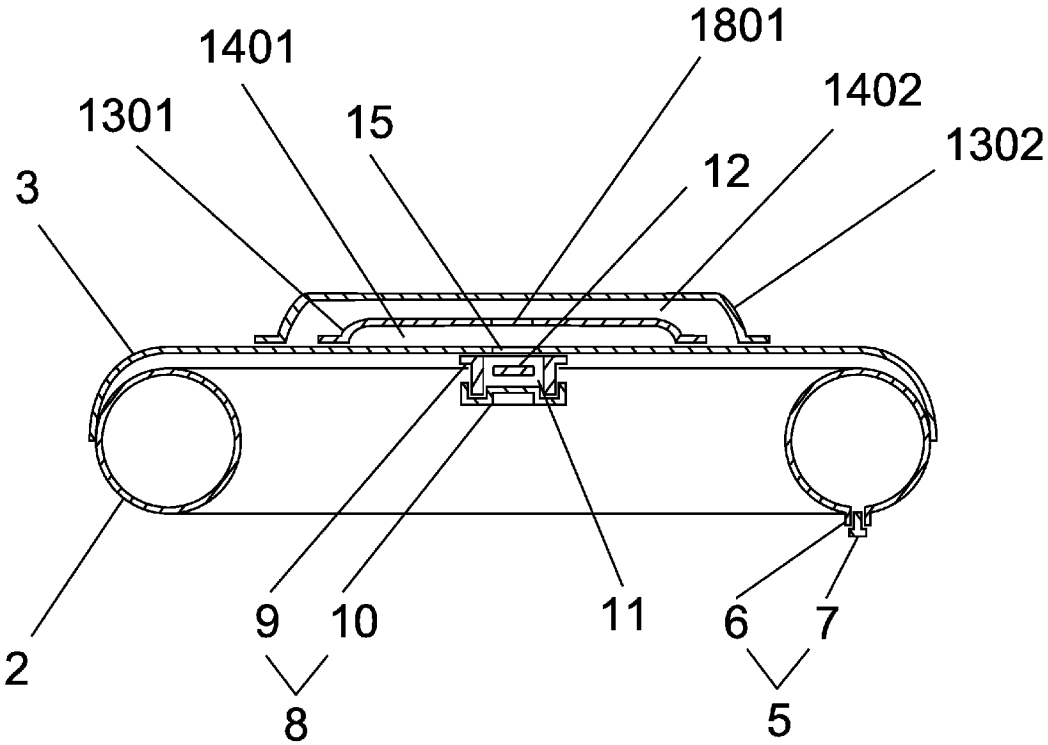
FIG. 6 illustrates a cross-sectional view of the third embodiment of the invention.
Figure 6A:
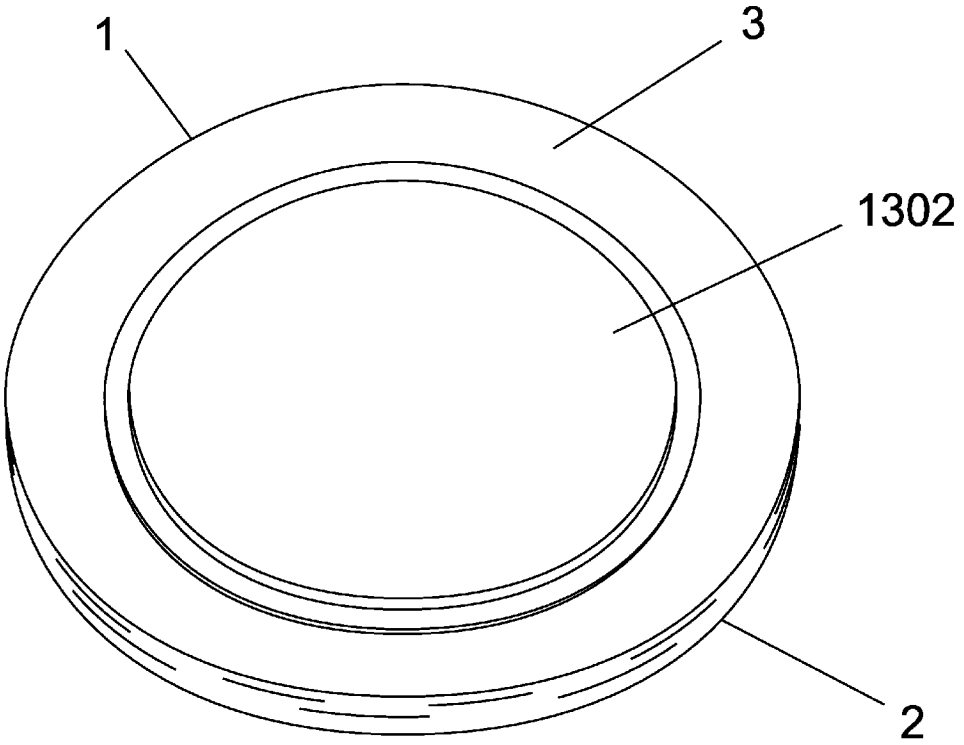
FIG. 6A illustrates a perspective view from top of the third embodiment of the invention.

FIG. 6 is a cross-sectional view of the third embodiment of the invention. FIG. 6A illustrates a perspective view from top of the third embodiment of the invention.

The size of first top membrane 1301 is between the outer perimeter of water-tight chamber 8, and the outer perimeter of second top membrane 1302. The size of second top membrane 1302 is between the outer perimeter of first top membrane 1301, and the circumference of inflatable annular body 2. First top membrane 1301 isis attached, along its perimeter onto base membrane 3, forming a first membrane compartment 1401. Only one water-tight chamber 8 is shown, but the present invention is have be more than one if necessary. Water-tight chamber 8 is attached to the underside of base membrane 3 of inflatable flying disc 1. A base membrane opening 15 isis formed at a position corresponds to first chamber compartment 11, connecting first membrane compartment 1401 to first chamber compartment 11. Second top membrane 1302 isis attached, along its perimeter, onto base membrane 3, the compartment enclosed by base membrane 3, first top membrane 1301 and second top membrane 1302 becomes a second membrane compartment 1402. A first membrane opening 1801 is formed at a position corresponding to first chamber compartment 11, connecting the second membrane compartment 1402 to the first membrane compartment 1401. The electronic device 12 is placed, through the opening 91, into the first chamber compartment 11, or then, through the base membrane opening 15, into the first membrane compartment 1401, or further, through the first membrane opening 1801, into the second membrane compartment 1402.

Figure 7:
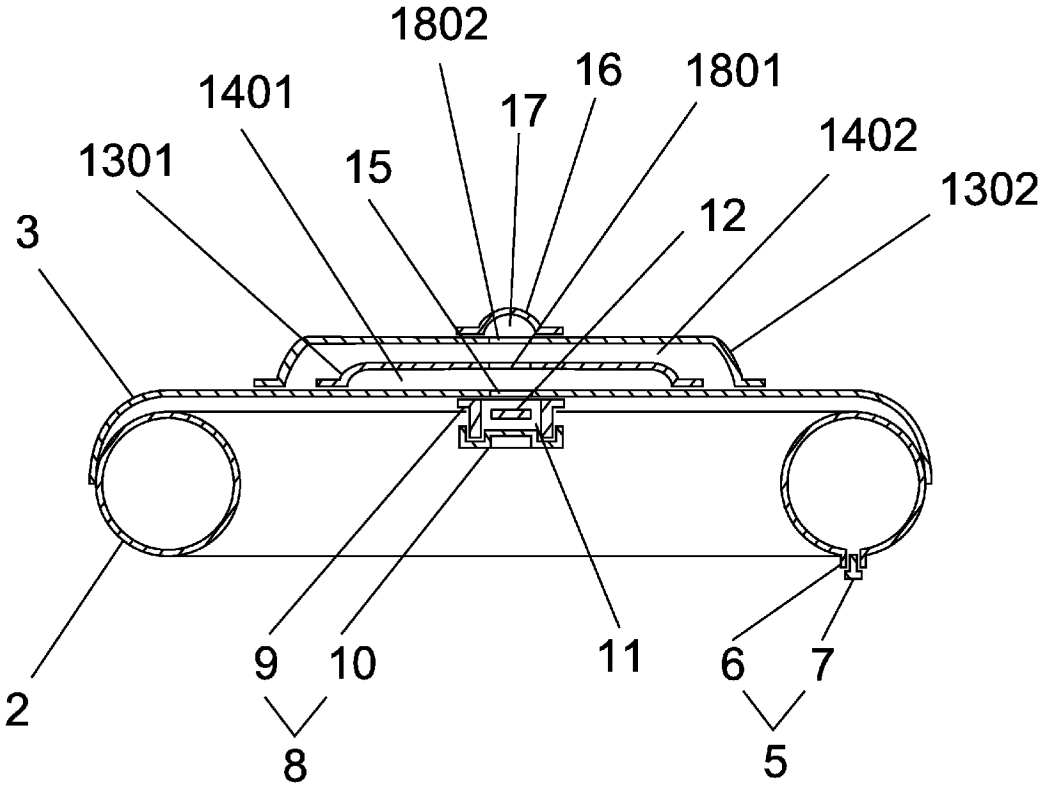
FIG. 7 illustrates a cross-sectional view of the fourth embodiment of the invention.
Figure 7A:
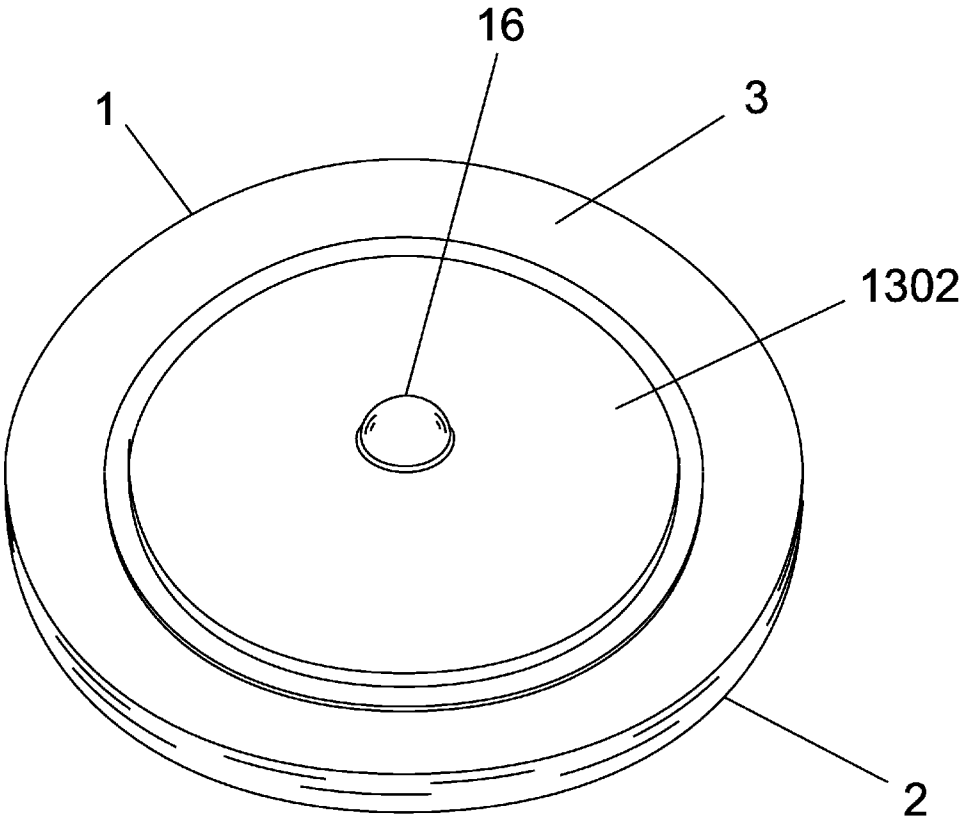
FIG. 7A illustrates a perspective view from top of the fourth embodiment of the invention.

FIG. 7 is a cross-sectional view of the fourth embodiment of the invention. FIG. 7A illustrates a perspective view from top of the fourth embodiment of the invention.

The first top membrane 1301 is positioned between the outer perimeter of water-tight chamber 8, and the outer perimeter of second top membrane 1302. The second top membrane 1302 is positioned between the outer perimeter of first top membrane 1301, and the circumference of inflatable annular body 2. The first top membrane 1301 is attached, along its perimeter onto base membrane 3, forming a first membrane compartment 1401. Only one water-tight chamber 8 is shown, but there is more than one if necessary. The watertight chamber 8 is attached to the underside of the base membrane 3 of the inflatable flying disc 1. A base membrane opening 15 isis formed at a position corresponding to the first chamber compartment 11, connecting the first membrane compartment 1401 to the first chamber compartment 11. The second top membrane 1302 is attached, along its perimeter, onto the base membrane 3, the compartment enclosed by base membrane 3, the first top membrane 1301, and the second top membrane 1302 becomes a second membrane compartment 1402. A first membrane opening 1801 is formed at a position corresponding to the first chamber compartment 11, connecting the second membrane compartment 1402 to the first membrane compartment 1401. A hood 16 isis attached to the upper side of the second top membrane 1302, at a position corresponding to the water-tight chamber 8, forming a hood compartment 17. A second membrane opening 1802 is formed, connecting the second membrane compartment 1402 and the hood compartment 17. The functions of the hood 16 isis: a) providing a third enclosed compartment 17, hence expanding the capacity of the first chamber compartment 11, the first membrane compartment 1401, and the second membrane compartment 1402, for housing electronic devices; b) providing a light effect from the light emitting components 125 and 131 which is seen on the upper side of the inflatable flying disc 1; c) balancing the weight of the water-tight chamber 8, allowing a smoother and steadier flight of the inflatable flying disc 1. The electronic device 12 is placed, through the opening 91, into the first chamber compartment 11, or then, through the base membrane opening 15, into the first membrane compartment 1401, or then, through the first membrane opening 1801, into the second membrane compartment 1402, or further, through the second membrane opening 1802, into the hood compartment 17.

Figure 10:
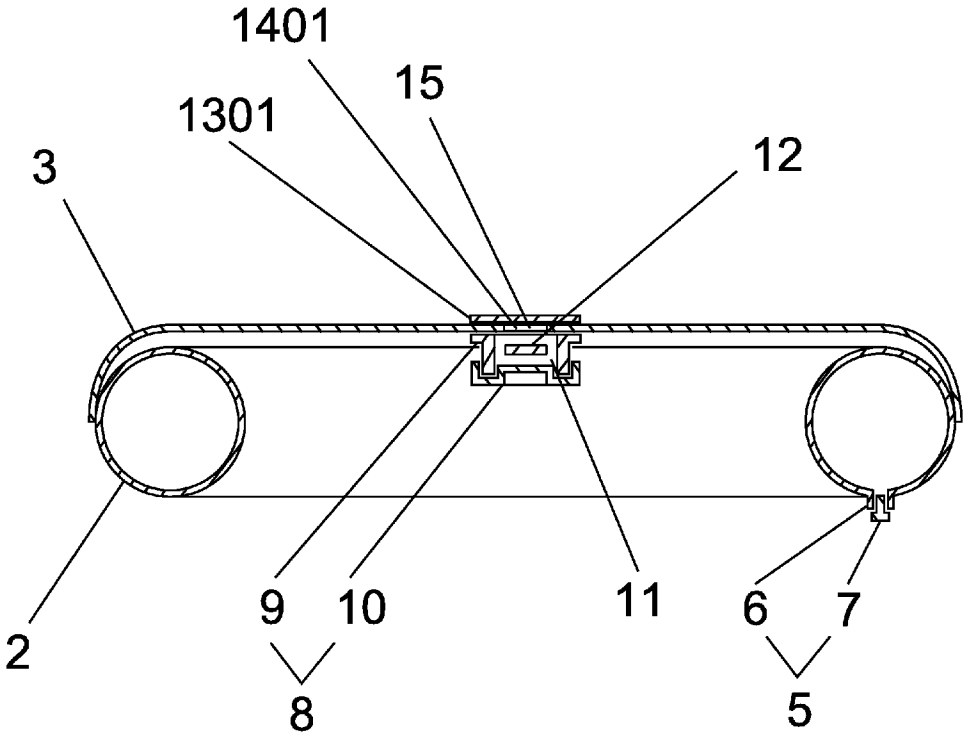
FIG. 10 illustrates a cross-sectional view of the fifth embodiment of the invention.
Figure 10A:
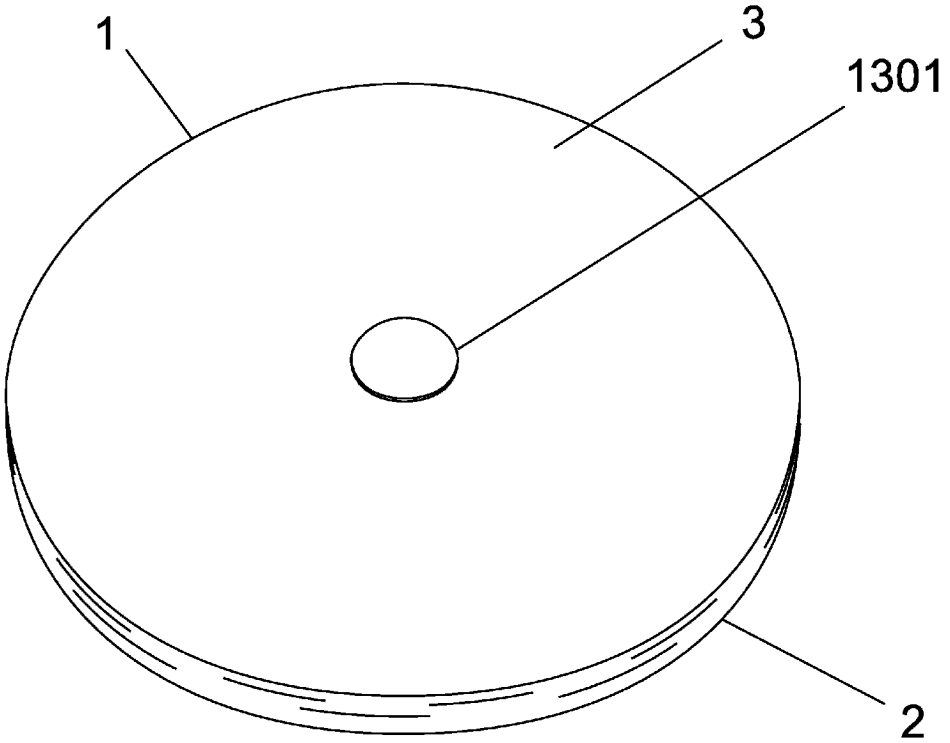
FIG. 10A illustrates a perspective view from top of the fifth embodiment of the invention.

FIG. 10 is a cross-sectional view of the fifth embodiment of the present invention. FIG. 10A illustrates a perspective view from top of the fifth embodiment of the invention.

The first top membrane 1301 is attached onto base membrane 3, forming a first membrane compartment 1401. The second top membrane 1302 is not shown. The size of first top membrane 1301 is extend to the outer perimeter of water-tight chamber 8. Only one water-tight chamber 8 is shown. The watertight chamber 8 is attached to the underside of the base membrane 3 of the inflatable flying disc 1. A base membrane opening 15 is formed at a position corresponding to the first chamber compartment 11, connecting the first membrane compartment 1401 to the first chamber compartment 11. The first membrane compartment 1401 and the base membrane opening 15 is overlap each other. The electronic device 12 is placed into the first chamber compartment 11, or further into the first membrane compartment 1401.

Figure 11:
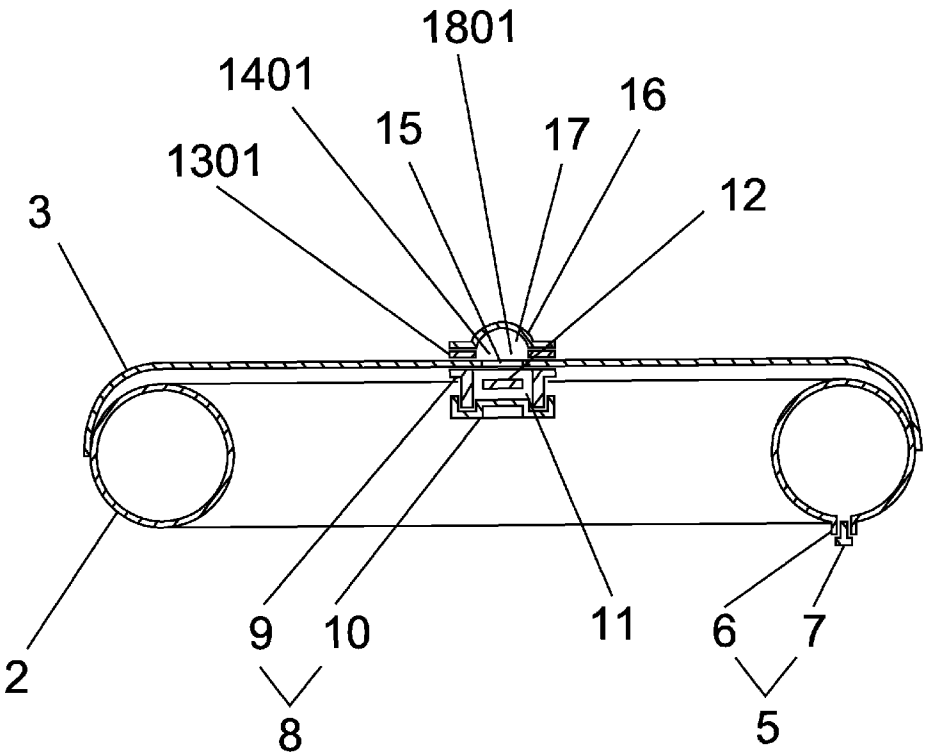
FIG. 11 illustrates a cross-sectional view of the sixth embodiment of the invention.
Figure 11A:
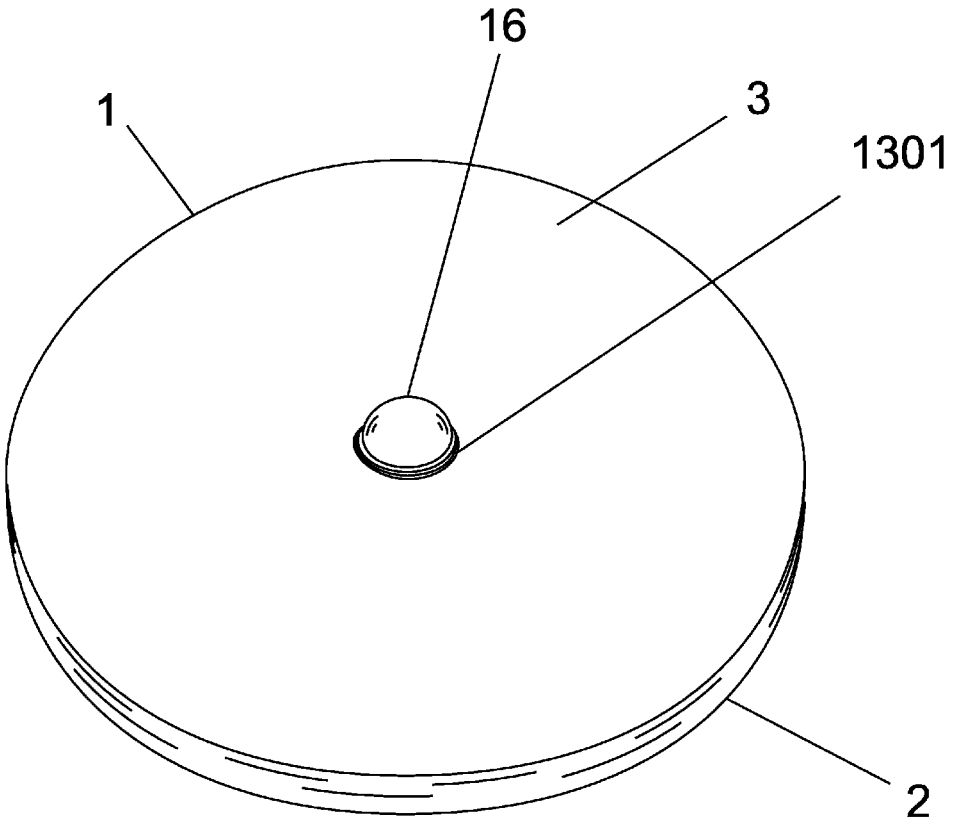
FIG. 11A illustrates a perspective view from top of the sixth embodiment of the invention.

FIG. 11 is a cross-sectional view of the sixth embodiment of the present invention. FIG. 11A illustrates a perspective view from top of the sixth embodiment of the invention.

The first top membrane 1301 is attached onto the base membrane 3, forming a first membrane compartment 1401. The second top membrane 1302 is not shown. The first top membrane 1301 is extend to the outer perimeter of the water-tight chamber 8. Only one water-tight chamber 8 is shown. The watertight chamber 8 is attached to the underside of the base membrane 3 of the inflatable flying disc 1. A hood 16 is attached to the upper side of first top membrane 1301, on top of the water-tight chamber 8, forming a hood compartment 17. A base membrane opening 15 isis to be formed, connecting the first chamber compartment 11 and the first membrane compartment 1401. A first membrane opening 1801 is to be formed, connecting the first membrane compartment 1401 and the hood compartment 17. The first membrane compartment 1401, the base membrane opening 15, and the first membrane opening 1801 is overlap each other. The functions of the hood 16 isis: a) providing a hood compartment 17, hence expanding the capacity of the first chamber compartment 11 and the first membrane compartment 1401 for the the housing electronic devices; b) generating a light effect from the light emitting components 125 and 131 which isis seen on the upper side of the inflatable flying disc 1; c) balancing the weight of the water-tight chamber 8, providing a smoother and steadier flight of the inflatable flying disc 1. The electronic device 12 isis placed into the first chamber compartment 11, or then into the first membrane compartment 1401, or further into the hood compartment 17.

Figure 12:
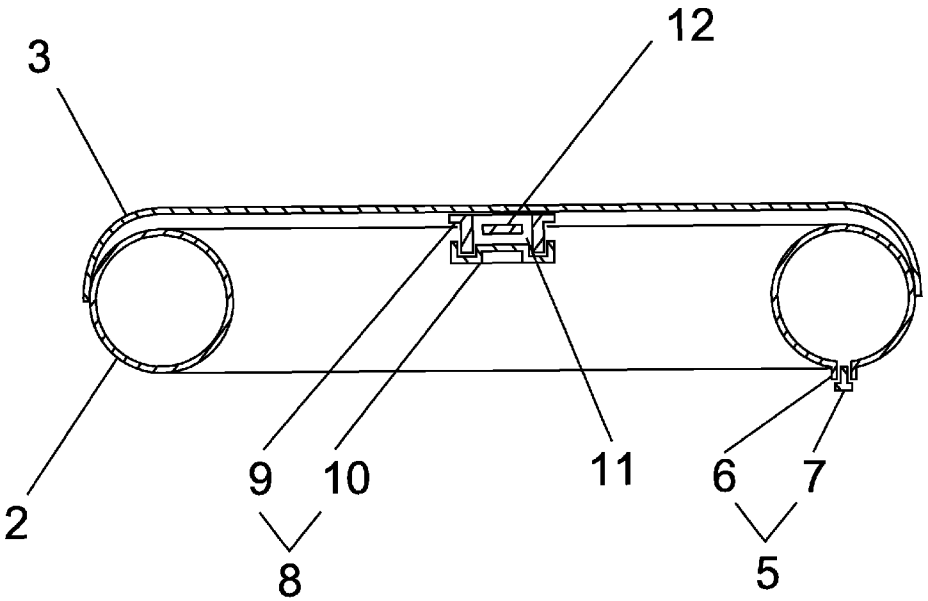
FIG. 12 illustrates a cross-sectional view of the seventh embodiment of the invention.
Figure 12A:
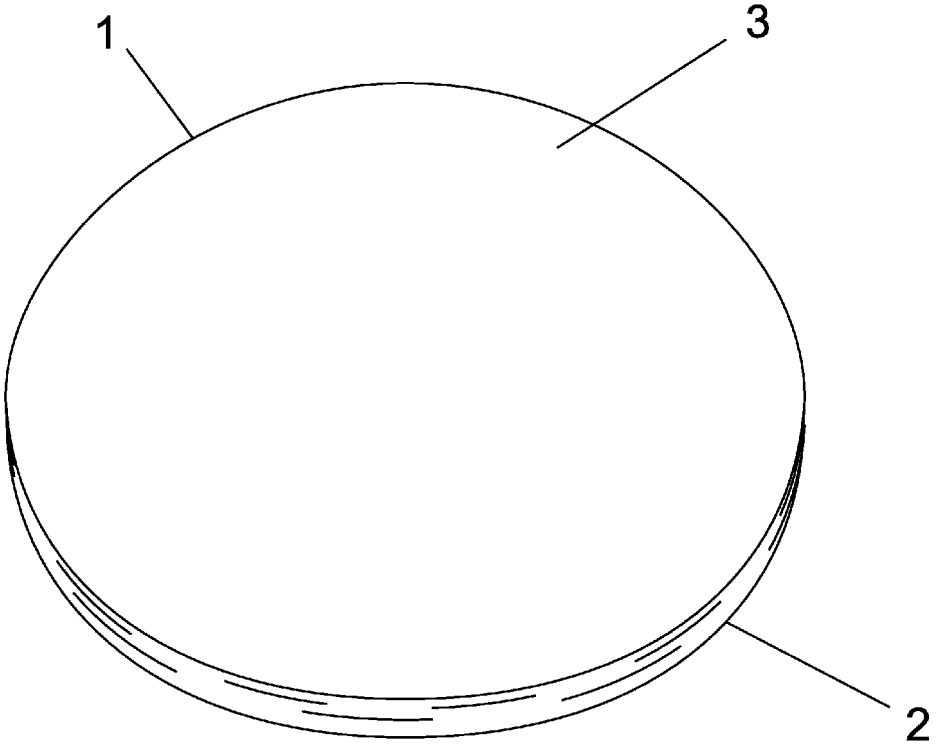
FIG. 12A illustrates a perspective view from top of the seventh embodiment of the invention.

FIG. 12 is a cross-sectional view of the seventh embodiment of the present invention. FIG. 12A illustrates a perspective view from top of the seventh embodiment of the invention.

The first top membrane 1301 and the second top membrane 1302 are not shown. Only one water-tight chamber 8 is shown, but there isis more than one if necessary. The water-tight chamber 8 isis attached to the underside of the base membrane 3 of the inflatable flying disc 1. The electronic device 12 isis housed in the first chamber compartment 11.

Figure 13:
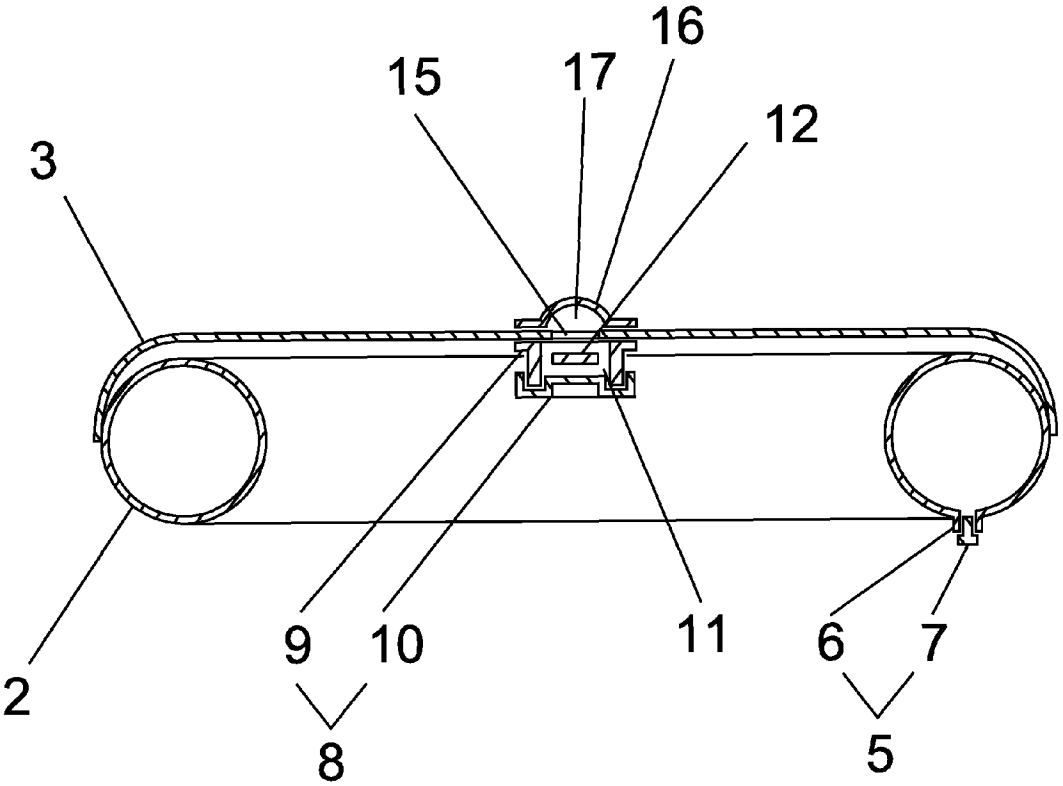
FIG. 13 illustrates a cross-sectional view of the eighth embodiment of the invention.
Figure 13A:
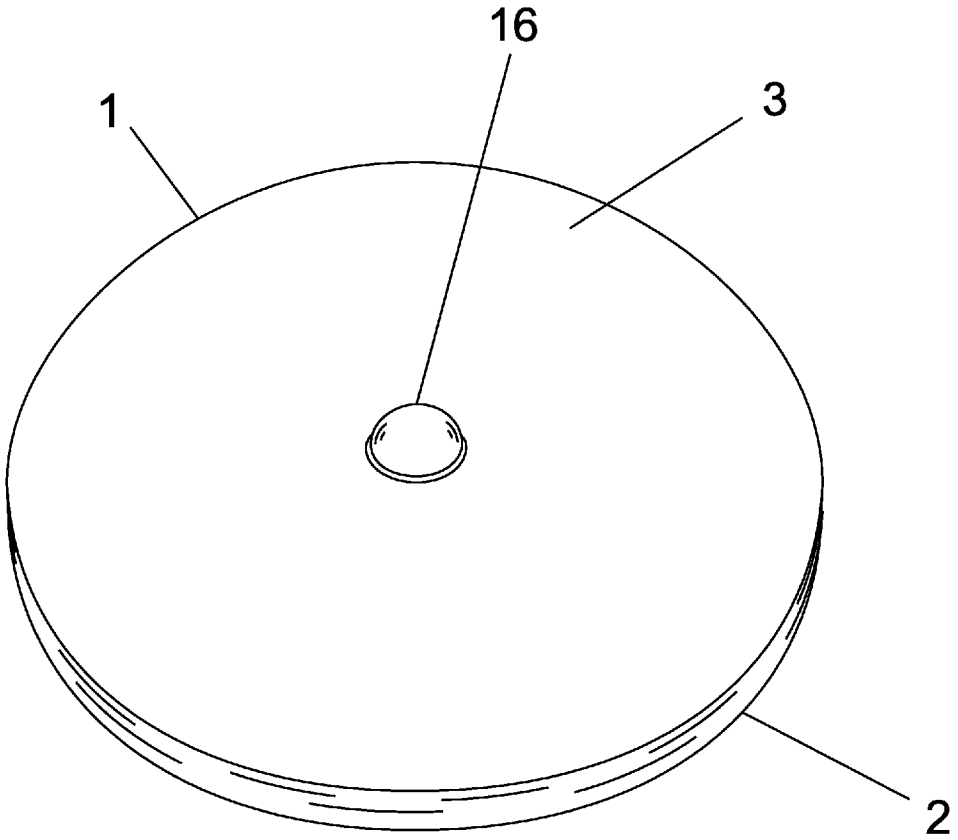
FIG. 13A illustrates a perspective view from top of the eighth embodiment of the invention.

FIG. 13 is a cross-sectional view of the eighth embodiment of the present invention. FIG. 13A illustrates a perspective view from top of the eighth embodiment of the invention.

The first top membrane 1301 and the second top membrane 1302 are not shown. Only one water-tight chamber 8 is shown, but there isis more than one if necessary. The water-tight chamber 8 isis attached to the underside of the base membrane 3 of the inflatable flying disc 1. A hood 16 isis attached onto the upper side of the base membrane 3, on top of the water-tight chamber 8, forming a hood compartment 17. A base membrane opening 15 isis formed, connecting the first chamber compartment 11 and the hood compartment 17. The functions of the hood 16 isis: a) providing a hood compartment 17, hence expanding the capacity of the first chamber compartment 11 for housing electronic devices; b) generating a light effect from the light emitting components 125 and 131 which isis seen on the upper side of the inflatable flying disc 1; c) balancing the weight of the water-tight chamber 8, allowing a smoother and steadier flight of the inflatable flying disc 1. The electronic device 12 isis placed into the first chamber compartment 11, or then into the hood compartment 17.

Inflatable annular body 2, base membrane 3, first top membrane 1301, and second top membrane 1302, isis formed from soft plastic film or other appropriate material, which isis transparent, translucent, or opaque.

The procedure of installing the electronic device 12 into, or replacing it from inflatable flying disc 1 isis as follows. The watertight chamber cap 10 isis detached from the chamber base 9. The electronic device 12 is then be placed into the first chamber compartment 11, or next into the first membrane compartment 1401, or next into the second membrane compartment 402, or further into the hood compartment 17, or vice versa. The watertight cap 10 isis then attached back to chamber base 9, completing the installation or replacement procedure.

The first light emitting component 125 isis connected to the LED2 pad of controller 122 and cathode of battery 123 by electrical wires. Similarly, second light emitting component 132 isis connected to the LED1 pad of the (the) controller 122 and cathode of battery 123 by electrical wires. By using different lengths of electrical wires, and different color lights from the first light emitting component 125 and the second light emitting component 132, a variety of light effect and patterns isis displayed inside the first membrane compartment 1401 and the second membrane compartment 1402.

If the triggering switch 128 is a remote control signal receiver, the controller 122 is then be activated by remote controlled signals. The motor 129 is work together with a gyroscope to change the flying pattern or the trajectory of inflatable flying disc 1.

The inflatable flying disc 1 is a safe sporting or recreational article, because it is light-weight, flexible, and therefore is prevent players from being injured by its impact. It is easy to store, because its volume isis greatly reduced upon being deflated. The cost of transportation isis much lowered when it is being mass produced. The features such as the water-tight chamber 8, the base membrane 3, the first top membrane 1301, the second top membrane 1302, and the hood 16 are simple, low cost, easy to produce, yet they provide an effective solution for installing electronic device 12 into, or replacing it from the inflatable flying disc 1, without disturbing or damaging its air-tight body. The present invention will certainly bring along a craze of flying disc playing, and make it an even more popular sport.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. An inflatable flying disc, comprising:

an inflatable annular body having an air inlet to inflate and deflate the flying disc;

a circular base membrane being attached to the inflatable annular body along a peripheral edge of the inflatable annular body; and a first top membrane being positioned on top of the circular base membrane along a perimeter of the first top membrane, a base membrane opening is formed through said circular base membrane, a water-tight compartment communicates with said base membrane opening, an electronic device is retained in said water-tight chamber.

2. An inflatable flying disc as in claim 1, wherein the inflatable flying disc includes the water-tight chamber having a chamber base and a chamber cap.

3. An inflatable flying disc as in claim 2, wherein the size of first top membrane is between an outer perimeter of the water-tight chamber and the circumference of the inflatable annular body.

4. An inflatable flying disc as in claim 1, wherein the inflatable flying disc includes a hood attached onto an upper side of first top membrane, and an opening on first top membrane, at a position corresponding to the water-tight chamber, wherein the hood and the first top membrane form a hood compartment.

* * * * *